United States Patent [19]

Knowles et al.

[11] 4,171,858

[45] Oct. 23, 1979

[54] INSULATION DISPLACEMENT CONNECTOR FOR A FLAT MULTI-CONDUCTOR CABLE

[75] Inventors: Robert G. Knowles, Litchfield; Robert A. Domke, Newtown, both of Conn.

[73] Assignee: Litton Systems, Inc., Oakville, Conn.

[21] Appl. No.: 911,461

[22] Filed: Jun. 1, 1978

[51] Int. Cl.[2] ..... H01R 13/38

[52] U.S. Cl. ..... 339/99 R

[58] Field of Search ..... 339/97 R, 97 P, 98, 339/99 R, 258 R, 258 P

[56] References Cited

U.S. PATENT DOCUMENTS

| | | | |
|---|---|---|---|
| 3,910,672 | 10/1975 | Frantz | 339/97 P |
| 3,964,816 | 6/1976 | Narozny | 339/99 R |
| 3,990,767 | 11/1976 | Narozny | 339/97 P |
| 4,043,628 | 8/1977 | Narozny | 339/99 R |
| 4,073,560 | 2/1978 | Anhalt et al. | 339/99 R |

FOREIGN PATENT DOCUMENTS

| | | | |
|---|---|---|---|
| 2639196 | 3/1978 | Fed. Rep. of Germany | 339/99 R |

*Primary Examiner*—Joseph H. McGlynn
*Attorney, Agent, or Firm*—Brian L. Ribando

[57] ABSTRACT

A connector used in terminating a flat multi-conductor cable comprises a contact support and a pressure cap. The contact support houses a plurality of insulation displacement contacts, each contact comprising a boxlike end and an elongated electrical contacting section. Two opposite sides of the boxlike end include a longitudinal slot which receives the conductive elements of the cable to establish a four point contact therewith, and the remaining two sides are peaked to form a structure for piercing the insulation of the cable. The box is seamed along a longitudinal corner thereof and is reinforced by a recess in the contact support in which the box is located. The pressure cap comprises an array of apertures which correspond to the array of displacement contacts housed by the contact support. Each aperture is formed with a network of pressure members which cooperate to push the conductive elements of the multi-conductor cable into mating engagement with the slots of the displacement contacts, and to reinforce the boxlike ends.

12 Claims, 8 Drawing Figures

Fig_2
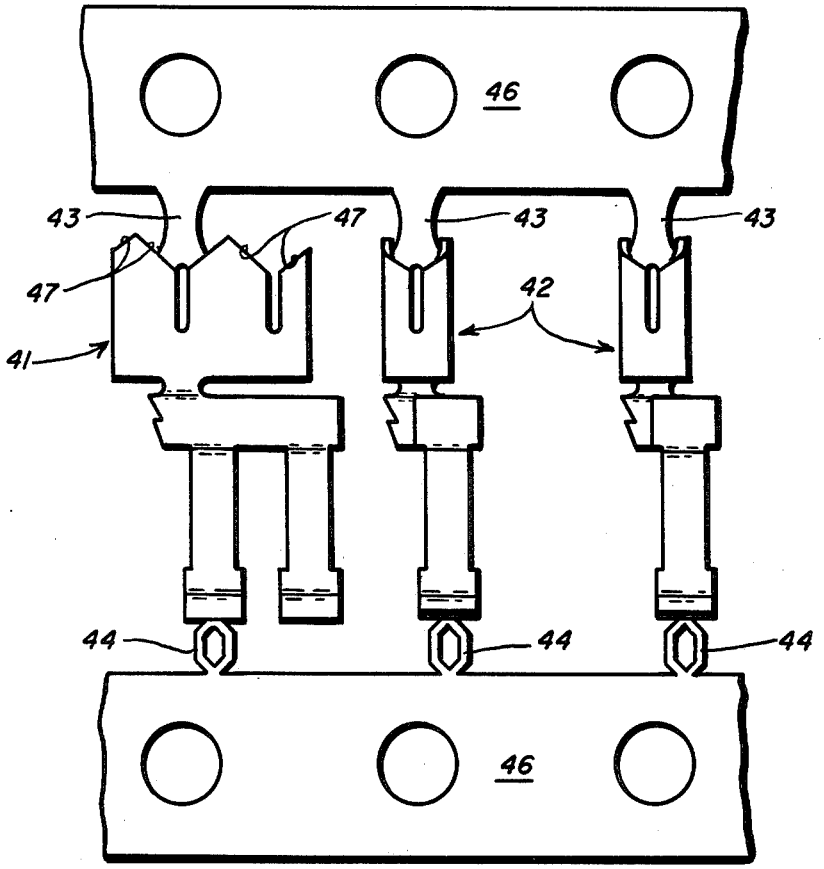
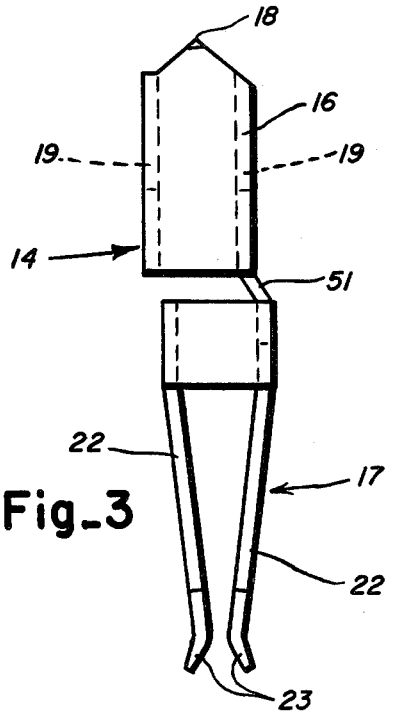
Fig_3
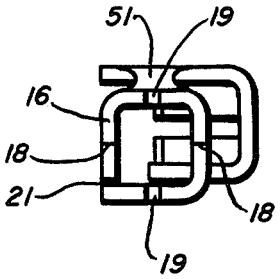
Fig_4

INSULATION DISPLACEMENT CONNECTOR FOR A FLAT MULTI-CONDUCTOR CABLE

BACKGROUND OF THE INVENTION

The use of a multi-conductor flat cable has become widespread in recent years. The cable, which is often color coded, provides a neat and expedient way of routing a high number of individual conductors along a common path. A variety of connectors for terminating such a cable are known in the prior art. The connector usually performs the functions of making an electrical connection with the conductors within the flat cable and of providing structure with which an external electrical connection may be made.

While the second function to be performed by a connector is easily effected, the first is not. Since it is desirable to make a connection with a flat cable without first dividing the cable into its individual conductors or without stripping the insulation from the cable, the portions of the connector which are to mate with the conductor bundles frequently take the form of blades or tines. The conductor bundles within a flat cable are often spaced one from the other on 0.050" centers, and consequently, the blades or tines of the connector must be very small and accurately positioned. Because the insulation surrounding the conductor bundles is tough and designed to resist tearing or splitting, the blades or tines must be rigid and capable of resisting deformation during use. A connector which performs satisfactorily and meets those prerequisites listed above is not known in the prior art.

SUMMARY AND OBJECTS OF THE INVENTION

An insulation displacement connector to be used in terminating flat multi-conductor cable comprises a lower contact support and a pressure cap which mates therewith. The contact support and the pressure cap are both formed of rigid insulating material. The contact support includes a plurality of recesses each of which receives an insulation displacement contact. Each contact comprises a boxlike end formed by symmetrically folding contact stock and an elongated electrical contacting section. The boxlike end comprises two opposite sides which include a longitudinal slot for receiving conductive elements of the flat multi-conductor cable and which establish a four point electrical contact therewith. The two remaining sides of the box are peaked and form structure which pierces the insulation of a cable, the insulation being further cut by a champfered edge formed along the top of the box. The box is seamed along a longitudinal corner thereof for strength, and is reinforced by the recess in the contact support in which the contact is positioned. The pressure cap comprises an array of apertures which correspond in number and position to the array of displacement contacts which are positioned in the lower support. Each aperture includes a pressure post, a web, and a rib which cooperate to push the conductive elements of the multi-conductor cable into a mating engagement with the slots formed on the walls of the boxlike end of the displacement contacts.

It is therefore an object of the invention to provide an insulation displacement connector for a flat multi-conductor cable.

It is another object of the invention to provide an insulation displacement connector comprising a boxlike end having a longitudinal seam along one corner thereof which may be used in terminating a flat multi-conductor cable.

It is a further object of the invention to provide a connector comprising an array of insulation displacement connectors wherein each connector comprises a boxlike end having a longitudinal slot in the corner thereof and is reinforced by a recess formed in the connector and which may be used for terminating flat multi-conductor cables.

It is still another object of the invention to provide an insulation displacement connector comprising a contact support for housing a plurality of contacts including a boxlike end having a longitudinal seam in one corner thereof and an elongated electrical contacting section together with a connector cap comprising structure which cooperates to push a flat multi-conductor cable into mating relationship with a plurality of boxlike ends.

These and other objects of the invention will become apparent from the following detailed description taken in conjunction with the accompanying drawing figures in which like reference numerals designate like or corresponding parts throughout the figures.

BRIEF DESCRIPTION OF THE DRAWING

FIG. 2 is a plan view of a plurality of connectors attached to a selvage strip;

FIG. 3 is a side view of a contact used in the connector of FIG. 1;

FIG. 4 is a top view of the contact of FIG. 3;

DESCRIPTION OF THE PREFERRED EMBODIMENT

Figure 1:
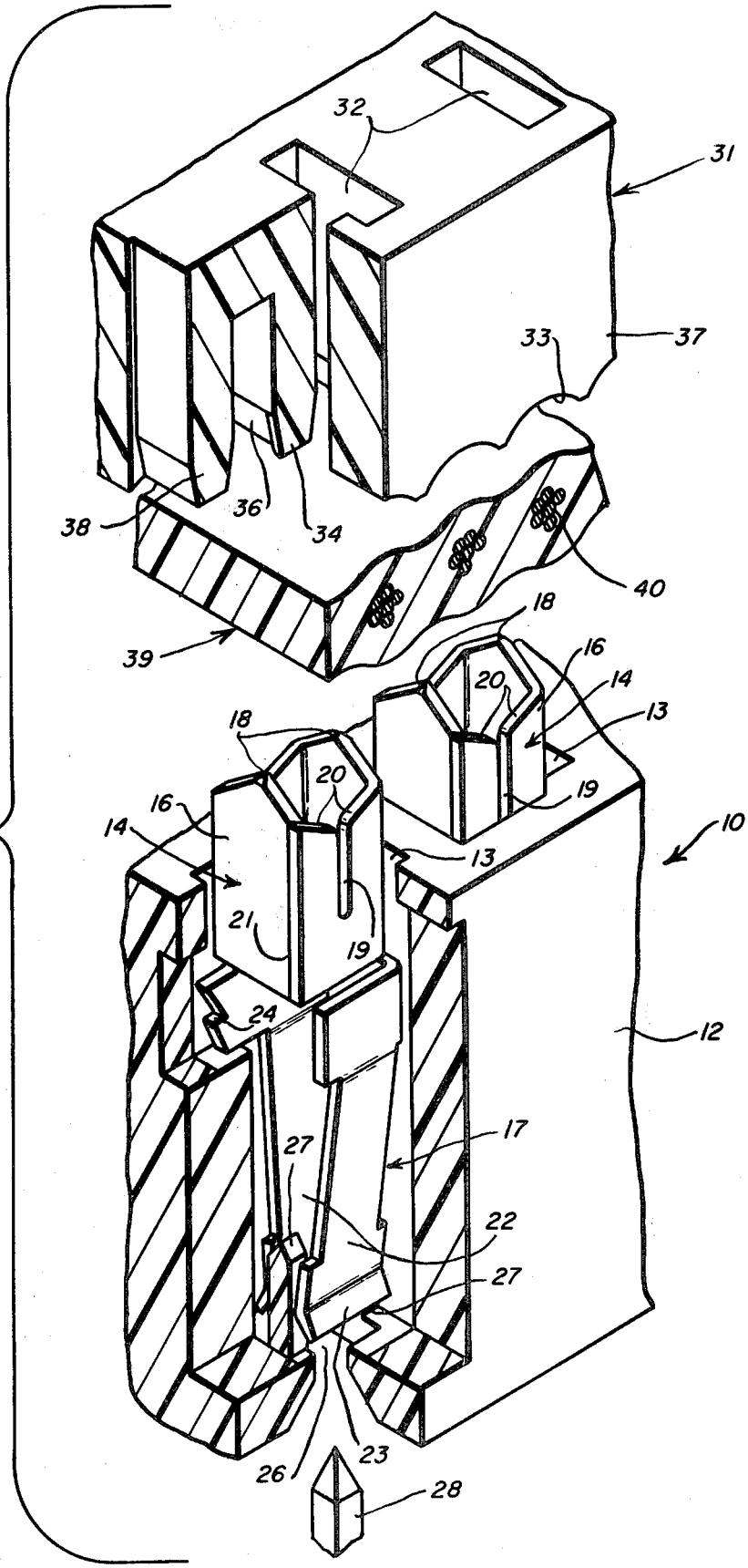
FIG. 1 is an exploded isometric view partly in section of a connector and flat cable according to the invention.

Referring now to the drawings, there is shown in FIG. 1 an insulation displacement connector generally designated by the reference numeral 10. The connector comprises a contact support 12 which may be formed of any rigid nonconducting material such as plastic. The contact support 12 is provided with a plurality of recesses 13, each of which receive an insulation displacement contact 14. Each contact 14 comprises a boxlike end 16 and an elongated electrical contact section 17. The material for the contact may be chosen from any of the classes of rigid materials which are electrically conductive.

The boxlike end 16 is quadrilateral and includes two opposite walls having insulation piercing peaks 18 and two opposite walls having longitudinal slots 19 formed therein. The top of the walls forming the boxlike end 16, as well as the walls of the slot 19, are formed with a cutting edge 20. The material forming the box is seamed along one corner 21.

In the embodiment shown, the electrical contacting section 17 comprises a double spring member contact 22 having flared ends 23. One portion of the double spring member contact 22 includes a barb 24 which bites into the wall of the recess 13 and prevents accidental removal of the contact when the same is inserted therein.

The end of the contact support 12 which is opposite the recesses 13 is formed with a plurality of tapered entry apertures 26, one for each of the contacts 14. Within each recess 13 and adjacent the entry aperture 26 is a pair of preloading centralizing barriers 27. The centralizing barriers 27 act to space the double spring member contacts 22 one from the other by a predetermined distance, and to center the said contacts 22 above the entry aperture 26. A square post 28, which may be the connector member of an external circuit, is shown in alignment with the entry aperture 26. It will be understood that the width of the square post 28 is greater than the distance between the contacting sections 22, and when the post is inserted into the connector 12, the contacting sections wipe the post 28 and establish electrical contact therewith. The cross sectional shape of the post 28 may be round, or tapered along its length, as desired.

A pressure cap 31 is shown in aligned relationship with the boxlike end 16 of an insulation displacement contact. The pressure cap 31 includes a plurality of probe access slots 32 which allow a test instrument to be inserted into the connector once the connector has been assembled. The pressure cap 31 is formed with a sculpted surface 33 on one side thereof and a pressure post 34 comprises a part thereof. The pressure post 34 is connected by a web 36 to the side walls 37 of the pressure cap 31. Ribs 38 are formed between the walls 37 of the pressure cap 31 and are parallel to the web 36. The geometry of the network of members including the pressure post 34, the webs 36, and the ribs 38 which comprise the sculpted surface 33 is such that a flat conductor cable 39 placed over the insulation piercing peaks 18 may be forced by the surface 33 into mating engagement with the boxlike ends 16. The pressure post 34 will bear on that portion of the cable which contains a conductor section 40, and the ribs 38 will closely surround the tapered walls of the boxlike contact preventing any appreciable distortion thereof.

Turning now to FIG. 2, a plurality of connector are shown in various forms which exist during the manufacturing process. The connectors 41 and 42 are shown attached by neck portions 43 and by yieldable portions 44 to selvage strips 46. The connector 41 is in a form as stamped from the flat stock which comprises the connectors. Asymetric folding of the flat stock will result in the connector form 42 which may be broken from the selvage strips 46 for subsequent use. A die cutting operation along the edge 47 adds champfer to the stock and creates the cutting edge which is required for insulation displacement.

Turning now to FIGS. 3 and 4, the details of the connector can be seen with greater clarity. A bridging section 51 connects the boxlike end 16 to the electrical contacting section 17. The bridging section 51 allows for an offset between the sections 16 and 17 where such an offset is required by the geometry of the contact support 12 and the recess 13 which may be formed therein. The seam 21 is formed where the wall including the peak 18 abuts with the wall including the slot 19.

Figure 5:
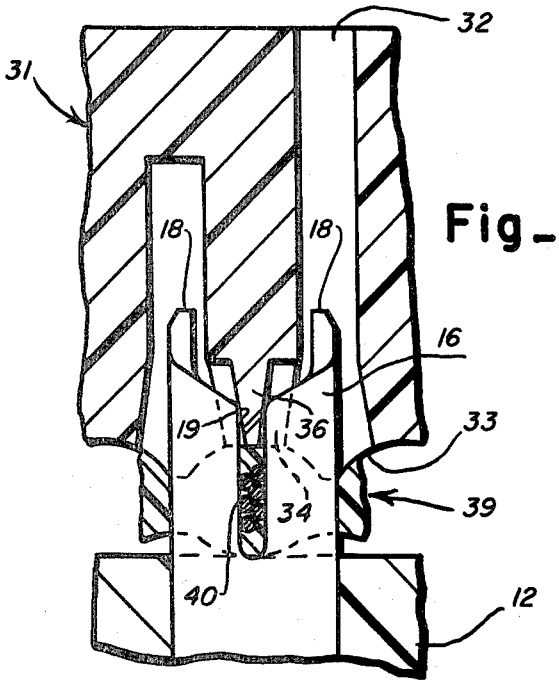
FIG. 5 is a partial front sectional view of a cable terminated by a connector.

The operation and use of the connector will be apparent to those skilled in the art. The contact support 12 supports an array of insulation displacement contacts 14. A multi-conductor cable 39 to be terminated which is placed on the contact array will rest on the peaks 18 of the individual contacts 14. The pressure cap 31 may be placed over the cable 39 and a force applied thereto to cause the peaks 18 to pierce through the insulation of the multi-conductor cable and the cutting edge 20 to slice further therethrough. The edge 20 of the walls of the boxlike end 16 which include the peaks 18 separate the multi-conductor cable 39 into a plurality of parallel cable sections, wherein each cable section includes a bundle of conductive strands 40. The V-shaped top edge of these walls which include the slots 19 will guide the bundle of conductive strands 40 to the slots 19 and a continued application of force to the pressure cap 31 will cause the pressure posts 34 and the webs 36 to follow the cable into the interior of the boxlike end 16 and the slots 19, respectively. A section of terminated cable is shown at FIG. 5.

Since the seam 21 of the boxlike end 16 is not coincident with the slots 19, but rather is located in one corner of the boxlike end, the inherent strength of the material forming the contact 14 will prevent the slot 19 from widening as the conductive strands 40 are forced into engagement therewith. The abutment of the wall which includes the slot 19 against the wall which includes the peak 18 in the region of the seam 21 will prevent the slotted wall from collapsing inwardly as the insulation of a cable is cut by the edge 20. The inner surfaces of the recesses 13 are closely positioned to the walls of the boxlike end 16 especially in the region of the seam 21 to prevent the outward displacement or distortion thereof. The sides of the two slots 19 in each contact 14 will establish a four point contact with the bundle of conductive strands 40 within the cable 39.

Figure 6:
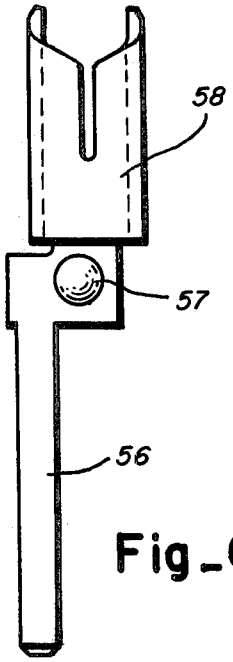
FIG. 6 is a front view of a contact having an elongated dip contact section.
Figure 7:
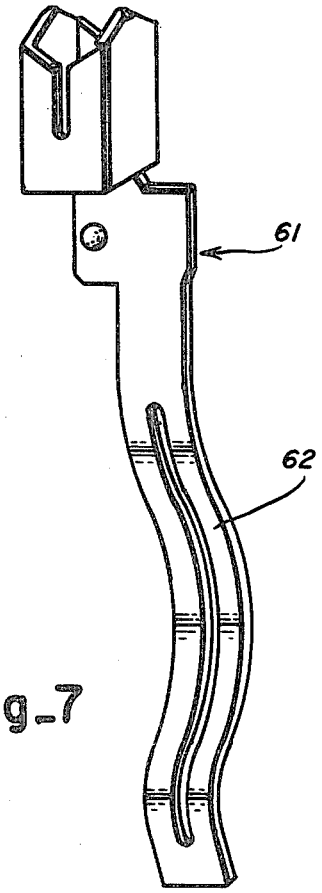
FIG. 7 and FIG. 8 are perspective views of contacts having alternative forms of elongated electrical contact sections.
Figure 8:
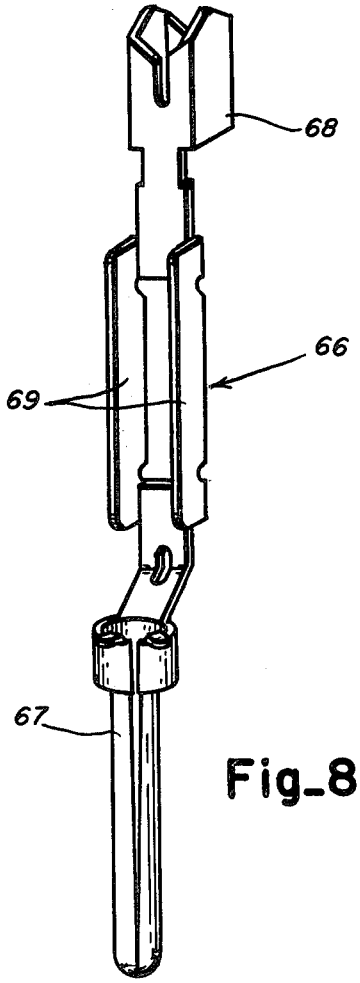

Turning now to FIGS. 6, 7, and 8, alternative forms of an electrical contacting section for an insulation displacement connector are shown. As shown in FIG. 6, the electrical contacting section comprises a dip contact section 56 which may be used where a dip solder connection is to be employed in making electrical connection with an external circuit element. The dip contact 56 is formed with a protuberance 57 on that portion of the contact immediately adjacent the boxlike end 58. The protuberance aids in retaining the contact within a mounting aperature in a contact support. FIG. 7 shows a connector 61 with an electrical contacting section in the form of a bifurcated beam contact 62. The beam contact 62 is used where the electrical contacting section is to mate with an edge card (not shown). FIG. 8 shows a connector 66 with an electrical contacting section in the form of a pin contact 67. The pin contact 67 is connected to the boxlike end 68 by a pair of parallelogram legs 69. The parallelogram legs 69 allow for an offset between the pin contact 67 and the end 68 where required. The pin contact 67 allows the connector 66 to mate with a socket (not shown).

Having thus described the invention, modifications and alterations thereof will occur to those skilled in the art, which modifications and alterations are intended to be within the scope of the present invention as defined in the appended claims.

We claim:

1. In a connector for terminating a flat multi-conductor cable wherein the cable comprises a plurality of side by side parallel conductors surrounded and separated from one another by pliant insulation material, and the connector comprises a contact support of rigid insulating material having a plurality of contact receiving recesses formed therein, the combination comprising:

a contact comprising a boxlike end, first means on said end for cutting said pliant insulation material along a line parallel to and between said conductors, second means on said end for cutting said pliant insulation along a line perpendicular to said conductors, third means on said end for establishing four point contact with said conductors, elongated contact means coupled to said boxlike end for making an electrical connection with an external circuit member, and seam means for establishing a juncture of material comprising said boxlike end, said seam means being positioned along one corner of said end.

2. The combination of claim 1 further comprising:

reinforcing means for said seam, said reinforcing means comprising one wall of said boxlike end and the rigid material of said housing.

3. The combination of claim 2 further comprising:

peaked walls and a cutting edge comprising said first means,

V-shaped cutting edges comprising said second means, slots having one end thereof in contiguous relationship with the apex of said V-shaped cutting edges comprising said third means.

4. The combination of claim 3 further comprising:

a pair of opposed spring contacts comprising said elongated contact means, an entry aperture in said support, and preloading centralizing barrier means within said support and adjacent said entry aperture for locating said opposed spring contacts and for spacing said contacts one from the other by a predetermined amount.

5. The combination of claim 3 further comprising:

a dip contact comprising said elongated contact means, said dip contact being adapted for connection with an external circuit member by dip soldering.

6. The combination of claim 3 further comprising:

a bifurcated beam contact comprising said elongated contact means, said bifurcated beam contact being adapted for electrical connection with an external circuit element comprising an edge card.

7. The combination of claim 3 further comprising:

a pin contact comprising said elongated contact means, said pin contact comprising a pair of parallelogram legs for offsetting said pin contact to said boxlike end, said pin contact being adapted for electrical connection with a socket.

8. In a connector for terminating a flat multi-conductor cable wherein the cable comprises a plurality of side by side parallel conductors surrounded and separated from one another by pliant insulation material, and wherein the connector comprises a contact support and a pressure cap both of rigid insulation material and a plurality of insulation displacement contacts, the combination comprising:

an array of recesses in said contact support for receiving said insulation displacement contacts, a boxlike end including two peaked walls and two slotted walls comprising each insulation displacement contact, seam means for establishing a juncture of material comprising said boxlike end, said seam means being positioned along one corner of said boxlike end, means on said pressure cap for forcing said parallel conductors into said slots to establish four point contact therewith, said means for forcing comprising a post dimensioned to fit within said boxlike end, web means for following said conductors into said slots, and rib means for confining said boxlike end to prevent distortion thereof.

9. The combination of claim 8 further comprising:

reinforcing means for said seam, said reinforcing means comprising one wall of said boxlike end and the rigid material of said housing.

10. The combination of claim 9 further comprising:

access means for allowing access from the exterior of said pressure cap through said pressure cap to said insulation displacement contact.

11. The combination of claim 9 further comprising:

elongated contact means coupled to said boxlike end for making an electrical connection with an external circuit member, an entry aperture in said support, said entry aperture providing access to said elongated contact means.

12. The combination of claim 11 further comprising:

access means for allowing access from the exterior of said pressure cap through said pressure cap to said insulation displacement contact.

* * * * *